United States Patent [19]

Arnold

[11] Patent Number: 4,643,502

[45] Date of Patent: Feb. 17, 1987

[54] DUPLEX OUTLET PROTECTION DEVICE

[76] Inventor: Michael Arnold, VSS Andrew Jackson SSBN 619G, FPO, New York, N.Y. 09575-2008

[21] Appl. No.: 820,109

[22] Filed: Jan. 21, 1986

[51] Int. Cl.[4] ..... H01R 13/44

[52] U.S. Cl. ..... 339/36; 174/67

[58] Field of Search ..... 174/66, 67; 339/36, 339/39

[56] References Cited

U.S. PATENT DOCUMENTS

| | | | |
|---|---|---|---|
| 2,516,464 | 7/1950 | Hooser | 174/67 |
| 2,526,606 | 10/1950 | Gregg | 174/67 |
| 2,722,665 | 11/1955 | Sauder | 174/67 |
| 2,892,172 | 6/1959 | McGann, Jr. | 339/36 |
| 2,987,690 | 6/1961 | Marbais | 174/67 |
| 2,997,520 | 8/1961 | Kinsman | 174/67 |
| 3,068,442 | 12/1962 | Kubik et al. | 339/36 |
| 3,163,481 | 12/1964 | Salvador | 339/75 |
| 3,200,989 | 8/1965 | Hubbell | 220/24.3 |
| 3,293,588 | 12/1966 | Blonder | 339/37 |
| 3,335,390 | 8/1967 | Pruonto et al. | 339/39 |
| 3,639,886 | 2/1972 | Drapkin | 339/36 |
| 3,859,454 | 1/1975 | Mann | 174/66 |
| 3,930,116 | 12/1975 | Richards | 174/66 |
| 4,424,407 | 1/1984 | Barbic | 174/67 |
| 4,484,185 | 11/1984 | Graves | 339/36 |

FOREIGN PATENT DOCUMENTS

| | | | |
|---|---|---|---|
| 939117 | 10/1963 | United Kingdom | 174/67 |

*Primary Examiner*—Gil Weidenfeld
*Assistant Examiner*—Paula A. Austin
*Attorney, Agent, or Firm*—Steele, Gould & Fried

[57] ABSTRACT

A duplex outlet protection device is disclosed which includes a base plate which is attached to the duplex receptacle. A dome-shaped hollow main body having an open bottom mounts upon the base plate and is vertically movable relative to the base plate between lower and upper positions. A stradler covers the bottom opening of the main body and is horizontally movable between a locking position wherein rearward portions of the stradler engage the base plate to prevent movement of the main body and an unlocked position wherein the main body is free to move relative to the base plate. A gravity door is vertically slidable in the main body between a lower position wherein the stradler is engaged in its locking position to prevent movement thereof and an upper position wherein the stradler will be free to be moved to its unlocked position.

9 Claims, 7 Drawing Figures

FIG. 1
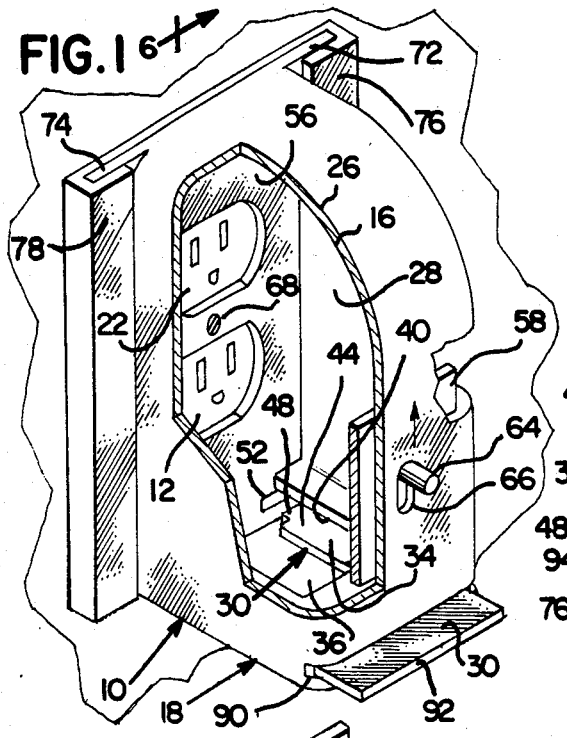
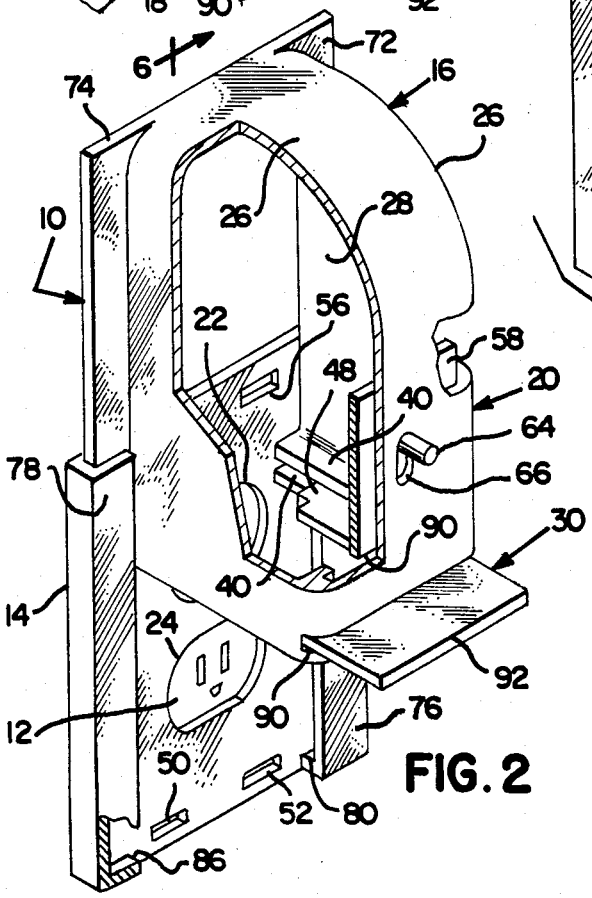
FIG. 2
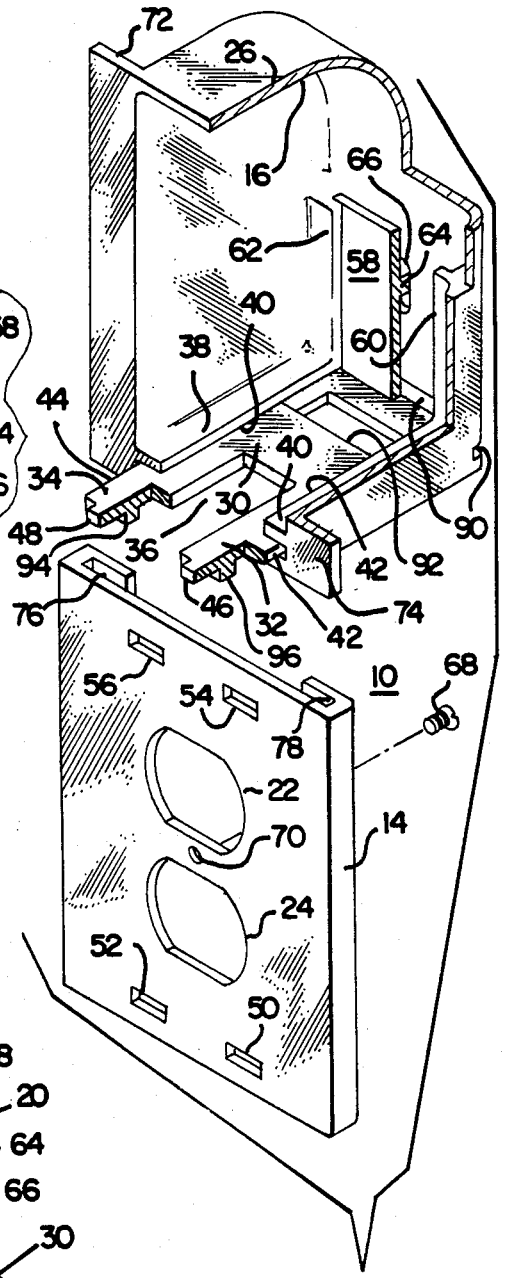
FIG. 3

FIG.4
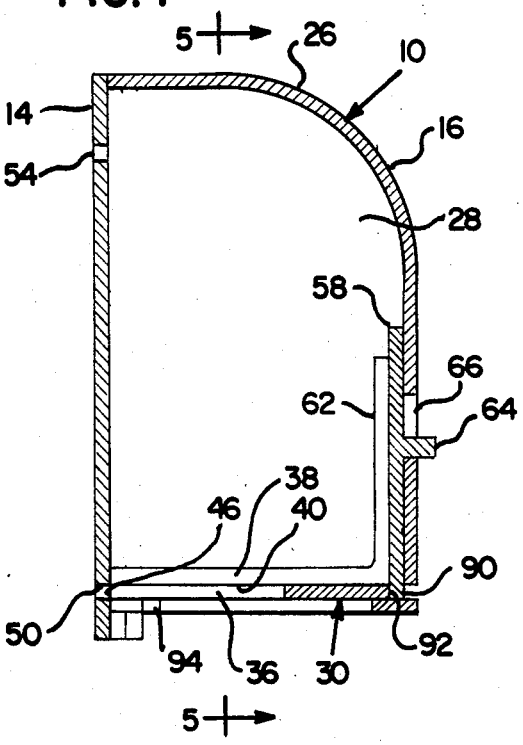
FIG.5
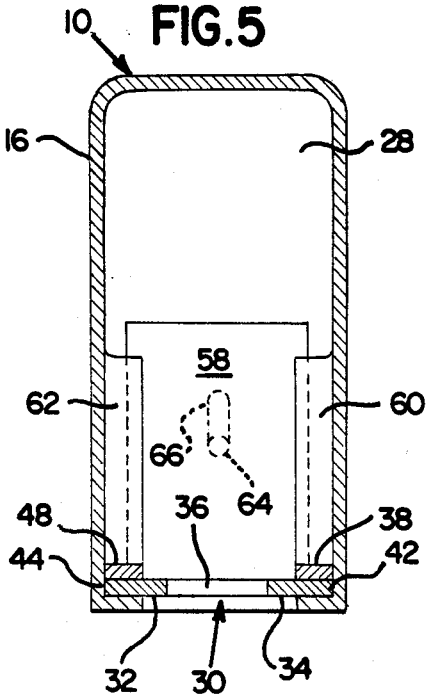
FIG.6
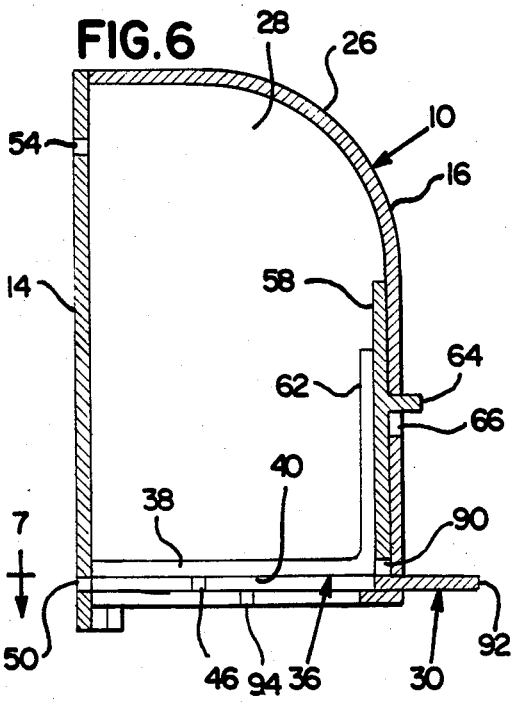
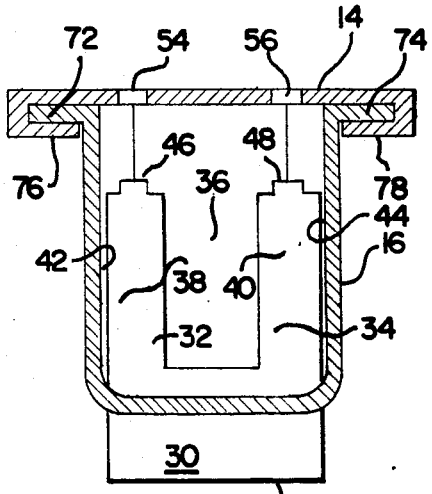
FIG.7

DUPLEX OUTLET PROTECTION DEVICE

BACKGROUND OF THE INVENTION

1. Field of the Invention

This invention relates generally to electrical outlet protection devices, more particularly, relates to a protective device suitable for direct installation over a duplex receptacle in an manner to allow easy access to the duplex receptacle while at the same time providing a child resistant construction.

2. Discussion of the Prior Art

The numerous, exposed duplex receptacles in and about homes and other properties has always presented a considerable electrical shock hazard to children and to inattentive adults. The duplex receptacles of course can cause a severe shock to anyone who may inadvertently or unintentionally make contact with the spaced, live, electrical contacts which are present immediately interiorly of the wall surface upon which the duplex receptacle is mounted. Accordingly, it is necessary to protect the exposed face of the duplex receptacle in order to prevent the insertion of foreign objects in a manner likely to carry live current from the rearwardly positioned electrical contacts to the front of the receptacle.

In U.S. Pat. No. 2,892,172 to McGann, Jr., a guard for electrical outlets has been disclosed which includes a guard element which is designed to secure over a duplex wall receptacle by employing a threaded stud. The guard essentially comprises an enclosing cover which is designed to allow electrical plugs to be inserted into the duplex wall receptacle in the usual manner and wherein the electrically live parts will be protected by the cover.

In U.S. Pat. No. 3,200,989, Hubbell discloses a locking cover for application over a duplex receptacle in a manner to protect the receptacle and any plugs which may be inserted into the receptacle. The cover is hingedly connected to the receptacle by a suitable pin in a position opposite to the locking construction to provide for the necessary access when desired.

In U.S. Pat. No. 3,639,886, Drapkin shows another type of weather proof electrical outlet box cover which is designed to fit directly over the duplex outlet box in a manner to protect electrical plugs which may be applied to the duplex receptacle. In this construction, the cover overfits both the receptacle and any installed plugs.

However, despite the efforts of the prior workers in the art, there still remains the need for an inexpensive, easily installed and aesthetically pleasing cover which may be easily applied over exposed duplex receptacles within a home by persons essentially unsophisticated in the use of hand tools so as to protect children and others from the risk of electrical shock in and about the usual duplex receptacles.

SUMMARY OF THE INVENTION

The present invention relates generally to the field of protecting electrical devices, and more particularly, is directed to a protective cover suitable for easy installation upon a duplex receptacle wherein electrical plugs may or may not be positioned.

The outlet protection device of the present invention comprises a base plate of suitable dimensions to overfit a conventional duplex receptacle in place of the existing cover plate and the base is designed to be secured in the same manner as the conventional cover plate. The base plate is provided with a pair of similar, spaced, side tracks to receive and slidingly retain the main body of the protection device. The main body is vertically slidable within the side tracks between a lower, plug protecting position and an upper plug accessible position. Accordingly, when it is desired to either insert or remove a plug relative to the duplex receptacle, the main body will be vertically elevated to its upper position to thereby allow complete access to the duplex receptacle and the plugs connected or to be connected therein. After the necessary operations at the duplex receptacle have been completed, the main body can then be lowered within the tracks to its lowermost, protective position whereby both the duplex receptacle and any plugs installed therein will be completely covered and protected.

The forward or front end of the main body is interiorly provided or equipped with a second set of vertical side tracks to receive therein a gravity door in limited, vertical sliding arrangement. The gravity door is equipped with a knob or similar forward projection to permit the gravity door to be raised vertically relative to the main body in a child-resisting construction. The bottom of the gravity door forwardly overfits the forward end of a horizontal stradler which is utilized to provide the bottom closure for the main body.

The horizontal stradler includes a central notch or opening of suitable size to receive in a relatively close engagement the one or more cords attached to the usual plugs which may be connected to the duplex receptacle. The stradler is designed to permit use of the duplex receptacle in the usual manner and at the same time to provide a safety construction to prevent children or others from having unwanted free access to the duplex receptacle itself. The stradler is positioned within a pair of spaced horizontal tracks which are provided near the bottom of the main body and is designed to have horizontal sliding movement within the horizontal tracks relative to the main body.

In use, when the gravity door is first elevated above the horizontal stradler, then the stradler may be moved relative to the main body in a manner to provide a substantially child-resistant construction. If the gravity door is not elevated, the stradler cannot be moved. The stradler terminates rearwardly in a pair of spaced fingers, which fingers serve to lock the main body upon the base plate in either a lower, duplex outlet protection position or in an upper, duplex outlet access position.

It is therefore an object the present invention to provide a novel duplex outlet protection device that is capable of installation upon a conventional duplex outlet in a manner to provide easy access to the outlet and at the same time to provide a child-resistant construction.

It is another object of the present invention to provide a novel duplex outlet protection device that includes a base plate that is attachable upon the duplex receptacle, a main body that is vertically slidable upon the base plate, the main body being provided with a gravity door and a horizontal stadler, the gravity door preventing horizontal movement of the stradler at all times when in its lower position during normal use of the device.

It is another object of the present invention to provide a novel duplex outlet protection device comprising base plate means affixed to the duplex outlet, main body means defining an enclosed, protective space, the main body means having vertical sliding movement relative to the base plate means, the main body means further comprising stradler means having horizontal movement relative to the main body means and a gravity door having a first, lower position which prevents horizontal movement of the stradler and a second, elevated position which permits horizontal movement of the stradler whereby a child-resistant outlet protector can be provided.

It is another object of the present invention to provide an improved duplex outlet protection device of the type set forth.

It is another object of the present invention to provide a novel duplex outlet protection device that is inexpensive to manufacture, simple in construction and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is a perspective view of a duplex outlet protection device installed upon a duplex outlet in the lower, protecting position and partially broken away to expose interior construction details.

FIG. 2 is a perspective view of the protection device similar to FIG. 1 showing the main body raised to its elevated position with parts broken away to expose interior construction details.

FIG. 3 is an exploded, rear elevational view of the outlet protection device, partly broken away to expose interior construction details.

FIG. 4 is a cross sectional view showing the stradler in its locking position.

FIG. 5 is a cross sectional view taken along line 5—5 on FIG. 4, looking in the direction of the arrows.

FIG. 6 is a cross sectional view similar to FIG. 4 and showing the stradler pulled to its forwardmost position.

FIG. 7 is a cross sectional view taken along the line 7—7 on FIG. 6, looking in the direction of the arrows.

DESCRIPTION OF THE PREFERRED EMBODIMENT OF THE INVENTION

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIGS. 1, 2 and 3 a protection device 10 suitable for installation upon a conventional duplex outlet 12 in a manner to selectively cover the outlet (and any plugs which may be installed therein) in a child-resistant manner.

The protection device 10 of the present invention comprises generally a stationary base plate 14 and a three dimensional, generally hollow main body 16, the main body being so constructed as to be vertically movable relative to the base plate 14. Still referring to FIGS. 1, 2 and 3, it will be seen that the main body 16 is movable from a lower, protecting position 18 as illustrated in FIG. 1 to an upper or elevated position 20 as shown in FIG. 2. When the main body 16 is in its protecting position 18, the main body will cover the receptacles 22, 24 of the duplex outlet 12 in a manner to prevent the touching of the receptacles by the fingers of a child (not shown). When the main body 16 is moved to its elevated position 20, then the receptacles 22, 24 will be fully exposed to thereby allow the user to readily insert or remove conventional plugs (not shown) relative to the receptacles 22, 24 in the usual manner.

Still referring to FIGS. 1, 2 and 3 with futher reference to FIGS. 4, 5, 6 and 7, the main body 16 is fabricated rearwardly to a generally rectangular configuration having a sloped, generally dome shaped top 26 of suitable size and shape to cover and define an interior space 28 of size to overfit the duplex receptacle 12 and any plugs (not illustrated) installed therein without undue interference.

The main body 16 terminates downwardly in a horizontally slidable stradler 30 which is designed to provide a child-resistant function. The stradler 30 is generally U-shaped in configuration and includes a pair of spaced, flat, horizontally oriented legs 32, 34, (FIG. 3) which legs define between them an open, cord receiving access slot 36 of suitable width to straddle one or more electrical cords (not shown) which may be extending from plugs installed in the duplex receptacle 12. The bottom of the main body 16 is provided with left and right, horizontal tracks 38, 40 to engage the lateral edges 42, 44 of the stradler 30 in a manner to permit horizontal sliding engagement of the stradler 30 relative to the main body 16.

The stradler legs 32, 34 terminate rearwardly in respective horizontal engaging fingers 46, 48 for locking engagement within either the pair of lower slots 50, 52 or the pair of upper slots 54, 56 which are provided in the base plate 14. Accordingly, when the engaging fingers 46, 48 of the stradler 30 are inserted into the lower slots 50, 52, the main body 16 will be locked against vertical movement upon the base plate 14 in a child resisting, lower protecting position 18. See FIGS. 1 and 4. When the engaging fingers 46, 48 of the stradler 30 are inserted into or engaged upon the upper slots 54, 56 of the base plate 14, then the main body 16 will be held in an elevated position 20 relative to the base plate 14, thereby allowing ready access to the electrical receptacles 22, 24 for the usual purposes. See FIG. 2.

Referring now particularly to FIGS. 1, 3, 4, 5, and 6, the front of the main body 16 is equipped with a vertical gravity door or gate 58 which may be in the form of a simple rectangular piece of plastic. The gate 58 has limited vertical sliding movement within the left and right tracks 60, 62 and is designed to lift vertically through a sufficient distance to provide horizontal sliding front clearance for the horizontally positioned stradler 30. Preferably, the gravity door 58 is equipped with a forwardly projecting pin 64, which pin projects forwardly through the elongated vertical opening 66 which is formed in the front wall of the main body 16. The vertical height of the elongated opening 66 defines the length of vertical travel of the pin 64 and subsequently the vertical travel distance of the gravity gate 58. It is intended that the pin 64 be elevated to the top of the opening 66 when it is desired to slide the main body 16 to the upper position 20 or the lower position 18. See FIGS. 2 and 6. When the main body 16 is lowered to its lower protecting position 18 as illustrated in FIG. 1, then the gate 58 will drop by gravity so that the pin 64 resides in the lower portion of the elongated opening 66. See FIGS. 4 and 5.

In use, the base plate 14 is initially secured to the duplex outlet 12 by first inserting a threaded fastener 68 through the base plate mounting hole 70 to threadedly engage the existing threaded opening that is conventionally provided in the duplex outlet 12 to normally secure an outlet cover plate (not shown). With the base plate 14 secured upon the duplex outlet 12, the side flanges 72, 74 of the main body 16 are urged within the left and right outer vertical tracks 76, 78 of the base plate 14 and always remain in vertical sliding engagement therewithin. The tracks 76, 78 terminate downwardly in respective bottom stops 80, 86 to limit the downward movement of the main body 16 relative to the base plate 14. Preferably, when the bottoms of the left and right flanges 72,74 stop against the respective bottom stops 80, 86 of the vertical tracks 76, 78, the lower base plate slots 50, 52 will horizontally register in planar alignment with the engaging fingers 46, 48 of the stradler 30.

Accordingly, when the main body 16 is in its lower, protecting position 18, the parts can be locked in a child resisting manner by simply pushing rearwardly on the stradler 30 to engage the fingers 46, 48 within the lower slots, 50, 52. This simple operation will prevent unwanted raising of the main body 16 relative to the base plate 14. As best seen in FIG. 4, when the stradler 30 is rearwardly pushed to engage the fingers 46, 48 within the respective lower slots 50, 52, sufficient forward clearance will then be provided to allow the gravity gate 58 to drop by gravity until the pin 64 reaches the lower limit of the elongated opening 66. In this manner, the lower extremity 90 of the gravity door 58 will drop in front of the front edge 92 of the stradler 30 to thereby prevent unwanted forward withdrawl of the stradler engaging fingers 46, 48 from the lower slots 50, 52.

When it is desired to elevate the main body 62 to the upper position 20 as illustrated in FIG. 2, two conscious operations will be required. That is, firstly, the gravity door 58 must be raised by lifting the pin 64 within the elongated opening 66 to thereby elevate the lower edge 90 of the gravity door above the horizontal plane of the stradler 30. With the gravity door 58 physically held in its upper position, the stradler 30 can then be urged away from the base plate 14 until the engaging fingers 46, 48 are pulled clear of the lower slots 50, 52. If desired, one or more finger pulls 94, 96 can be positioned on the lower surface of the stradler 30 to facilitate the horizontal reciprocal sliding movement of the stradler.

Once the engaging fingers 46, 48 have been urged outwardly of the lower slots 50, 52, the entire body 16 can then be raised relative to the base plate 14 by sliding the left and right side flanges 72, 74 within the left and right outer vertical tracks 76, 78 until the stradler 30 horizontally registers with the upper slots 54, 56. If desired, the stradler 30 can then be moved toward the base plate 14 and the stradler engaging fingers 46, 48 can be urged into the upper slots 54, 56 to thereby maintain the main body 16 in its elevated position 20 in the manner illustrated in FIG. 2.

Thus it is seen that a complete, protective and simply designed cover can be provided for a duplex receptacle in a manner to be substantially child resistant. It will be noted that two conscious efforts will be required to elevate the main body 16 relative to the base plate 14. First, it is necessary to raise the gravity gate 58 and second, it is required to horizontally move the slider 30. As is the case with child-proof closures for bottles, so long as two separate, conscious efforts will be required to open a container or to expose an electrical outlet, then the device can be considered as being truly child resistant.

Although the present invention has been described with reference to the particular embodiments herein set forth, it is understood that the present disclosure has been made only by way of example and that numerous changes in the details of the construction may be resorted to without departing from the spirit and scope of the invention. Thus, the scope of the invention should not be limited by the foregoing specification, but rather, only by the scope of the claims appended hereto.

What is claimed is:

1. A duplex outlet protection device comprising:

base plate means secured over the duplex outlet, the base plate means comprising track means;

main body means connected with the base plate means, the main body means comprising flange means in sliding engagement within the track means, the main body means terminating downwardly in an open bottom, the main body means being movable relative to the base plate means between a base plate protecting position and a base plate exposing position;

stradler means in sliding engagement with the main body means, the stradler means being positioned to cover at least part of the main body means open bottom, the stradler means being movable relative to the base plate means between a first position wherein a portion of the stradler means engages the base plate means and a second position wherein the stradler means does not contact the base plate means; and gravity door means in sliding engagement with the main body means, the gravity door means being angularly disposed relative to the stradler means, the gravity door means being movable relative to the main body means between a lower position and an upper position, the gravity door means being adapted to prevent sliding movement of the stradler means when in the said lower position and the permit sliding movement of the stradler means when in the said upper position;

whereby the main body means may be moved relative to the base plate means only when the stradler means is not in contact with the base plate means.

2. The duplex outlet protection device of claim 1 wherein the track means of the base plate means comprise left and right tracks and the flange means of the main body means comprise left and right flanges, each flange respectively being adapted for vertical sliding engagement within said track.

3. The duplex outlet protection device of claim 1 wherein the stradler means comprises a planar body and finger pull affixed to the body, the finger pull being positioned to extend outwardly from the main body means to facilitate movement of the stradler means.

4. The duplex outlet protection device of claim 1 wherein the track means comprises a pair of right and left, spaced, vertical tracks, the tracks terminating downwardly in bottom stops, the bottom stops being adapted to limit the downward movement of the main body means relative to the base plate means.

5. The duplex outlet protection device of claim 1 wherein the stradler means comprises a stradler of generally U-shaped configuration having a pair of legs defining an access slot therebetween.

6. The duplex outlet protection device of claim 5 wherein a stradler leg terminates at one end in an engaging finger and wherein the base plate means is provided with a lower slot, the engaging finger being positioned within the lower slot when the main body means is in its said protecting position to prevent movement of the main body means relative to the base plate means.

7. The duplex outlet protection device of claim 5 wherein the base plate means is provided with an upper slot, the engaging finger being positioned within the upper slot when the main body is in the said base plate exposing position.

8. The duplex outlet protection device of claim 1 wherein the gravity door means comprises a gravity door and projecting pin affixed to the door and projecting outwardly therefrom.

9. The duplex outlet protection device of claim 8 wherein the main body means is provided with a slot and wherein the said pin projects through and is movable within the slot.

* * * * *